United States Patent [19]

Hanson et al.

[11] 3,945,135

[45] Mar. 23, 1976

[54] SKI BOOT

[75] Inventors: Alden B. Hanson; Chris A. Hanson, both of Boulder, Colo.

[73] Assignee: Hanson Industries Inc., Boulder, Colo.

[22] Filed: Nov. 18, 1974

[21] Appl. No.: 524,720

Related U.S. Application Data

[63] Continuation-in-part of Ser. No. 450,547, March 13, 1974, abandoned.

[52] U.S. Cl. ..... 36/2.5 AL

[51] Int. Cl.[2] ..... A43B 00/00

[58] Field of Search ..... 36/2.5 R, 2.5 AL, 50

[56] References Cited

UNITED STATES PATENTS

| | | | |
|---|---|---|---|
| 3,530,594 | 9/1970 | Vogel | 36/2.5 AL |
| 3,696,534 | 10/1972 | Hornung | 36/2.5 AL |
| 3,803,730 | 4/1974 | Hanson et al. | 36/2.5 AL |

*Primary Examiner*—Patrick D. Lawson

*Attorney, Agent, or Firm*—Merriam, Marshall, Shapiro & Klose

[57] ABSTRACT

A rear entry ski boot which includes a vertical beam member which, when the boot is in the closed position, provides rigid support for an adjustable and pivotable cuff assembly, which supports the back and sides of the leg of the person wearing the ski boot.

22 Claims, 7 Drawing Figures

FIG.5
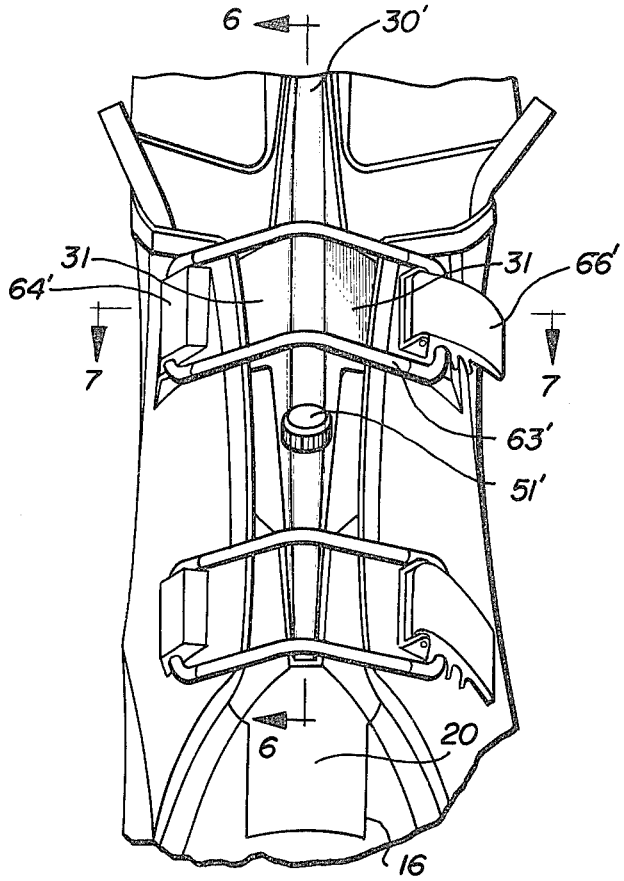
FIG.6
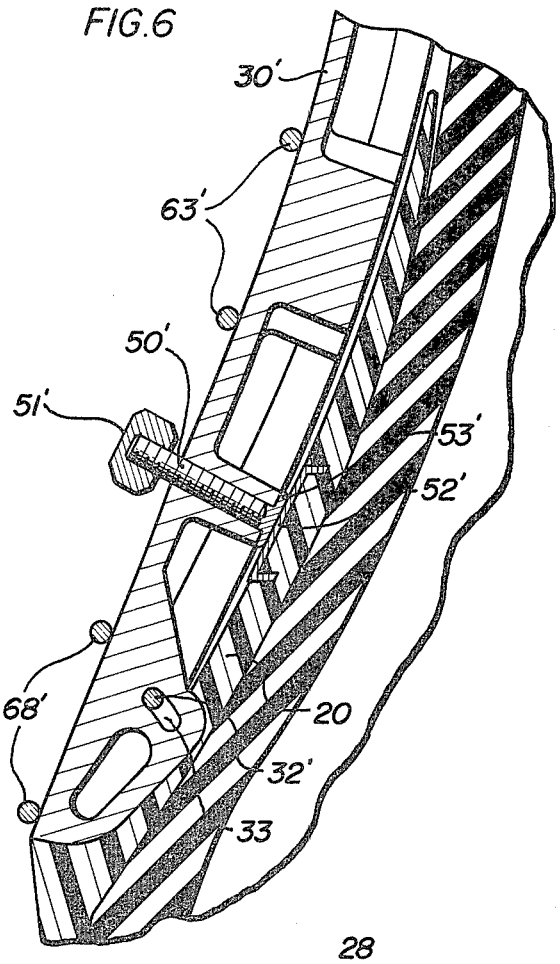
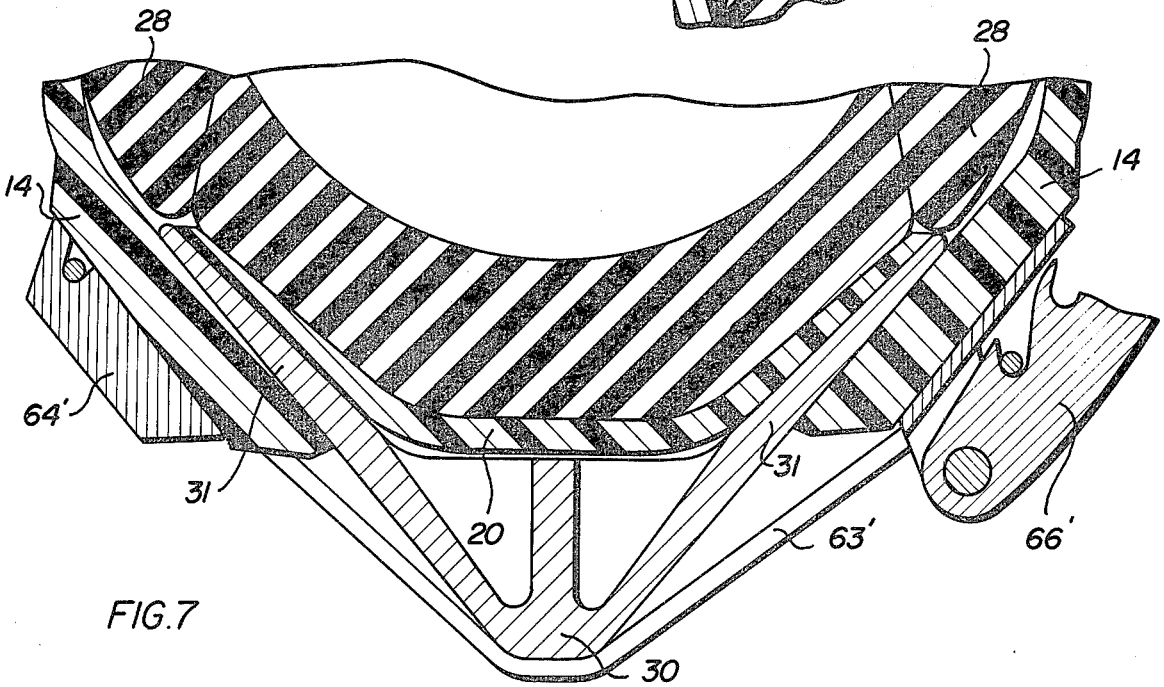
FIG.7

SKI BOOT

This application is a continuation-in-part of our copending application Ser. No. 450,547 filed Mar. 13, 1974, now abandoned.

BACKGROUND OF THE INVENTION

Ski boots formed of relatively rigid plastic materials have been available for a number of years. A more recent trend is to provide ski boots of a more flexible nature to allow increased comfort to the wearer. However, some skiing techniques, including for example, the technique employed by racers and others, require that the rear portion of the skis be weighted during skiing. In order to accomplish the weighting of the rear skis, it is necessary for the skier to lean back. If a relatively soft flexible boot is worn, it is difficult to exert the desired degree of pressure on the rear of the skis without danger of falling. This suggests the desirability of a boot having means to allow for proper weighting of the skis even in instances where the boot is fabricated from a relatively soft plastic material. Further, it is desired to have a ski boot which is adapted to adjustably increase the pressure on the heel and Achilles tendon of the wearer and also to provide a boot with means to cant the leg of the wearer relative to a ski.

SUMMARY OF THE INVENTION

The invention disclosed and claimed herein serves to provide the desired features for a boot. The present invention relates to ski boots, and more particularly to a rear entry ski boot having a vertical beam member with a cuff assembly which is pivotally attached to the upper portion of the beam member. The cuff members of the cuff assembly are adapted to support the back and sides of the wearer's leg so as to exert uniform pressure on the skier's leg.

The boot provides for a rigid beam member, at the rear of the ski boot, which beam member is firmly attached to the vamp, when the boot is in the closed position. A cuff assembly is attached to the upper end of the beam member. The cuff assembly comprises pivotable cuff members which support the back and sides of a wearer's leg and thereby enable the ski boot wearer to lean back and exert pressure on the cuffs, which pressure is transmitted through the beam and boot to the back of the skis without shifting the skier's center of gravity sufficiently to cause him to fall.

Adjustment means are provided, in connection with the beam member, whereby the fit and position of the wearer's foot within the ski boot can be adjusted conveniently. Preferably the beam member of the present invention is applied to a ski boot which includes provisions for adjusting the flex of the boot which is generated by the force of the skier's ankle when the skier is in a forward lean position. A boot having an adjustable flex means is described, for example, in U.S. Pat. No. 3,848,347.

The rigid beam structure of the present invention preferably is combined with a flexible type of ski boot. Thus the present invention can be adapted for use in a ski boot which provides a measure of comfort to the wearer, but which will permit the skier to properly weight the back of the skis when necessary in skiing. Further, since the cuff members may be individually and laterally adjusted relative to each other, the boot of the present invention provides an adjustable canting means.

Further, the present invention contemplates the use of an adjustable fitting mechanism which comprises a screw member which adjusts the position of the rear tongue of the ski boot. This provides a convenient means of adjusting the fit of the boot as is required for a particular skier to meet any conditions.

The ski boot of the present invention is adapted to be provided with a suitable liner and wax fitting system such as the liner fitting system of the type described in U.S. Pat. No. 3,798,799.

Moreover the present boot is adapted to be provided with interchangeable backs of the type described in U.S. Pat. No. 3,803,730. It is preferred to use the beam member of the present invention with boots of type which permit entry from the rear, as is disclosed and described herein, but it will be understood that other types of boots and liners may be utilized in connection with the invention disclosed and claimed herein.

DESCRIPTION OF THE DRAWINGS

A better understanding of the herein claimed invention will be had by reference to the accompanying drawings, wherein:

FIG. 5 is a partial, rear elevational view showing the incorporation of the preferred embodiment of the beam member in the ski boot of the present invention;

FIG. 6 is a partial, side elevational view taken in section along the line 6—6 of FIG. 5, showing the left half of a boot for the right foot, incorporating the preferred embodiment of the beam member in the ski boot of the present invention; and FIG. 7 is a partial top view of the boot taken in section along line 7—7 of FIG. 5, showing the preferred embodiment of the beam member in the ski boot of the present invention.

DETAILED DESCRIPTION OF THE INVENTION

Figure 1:
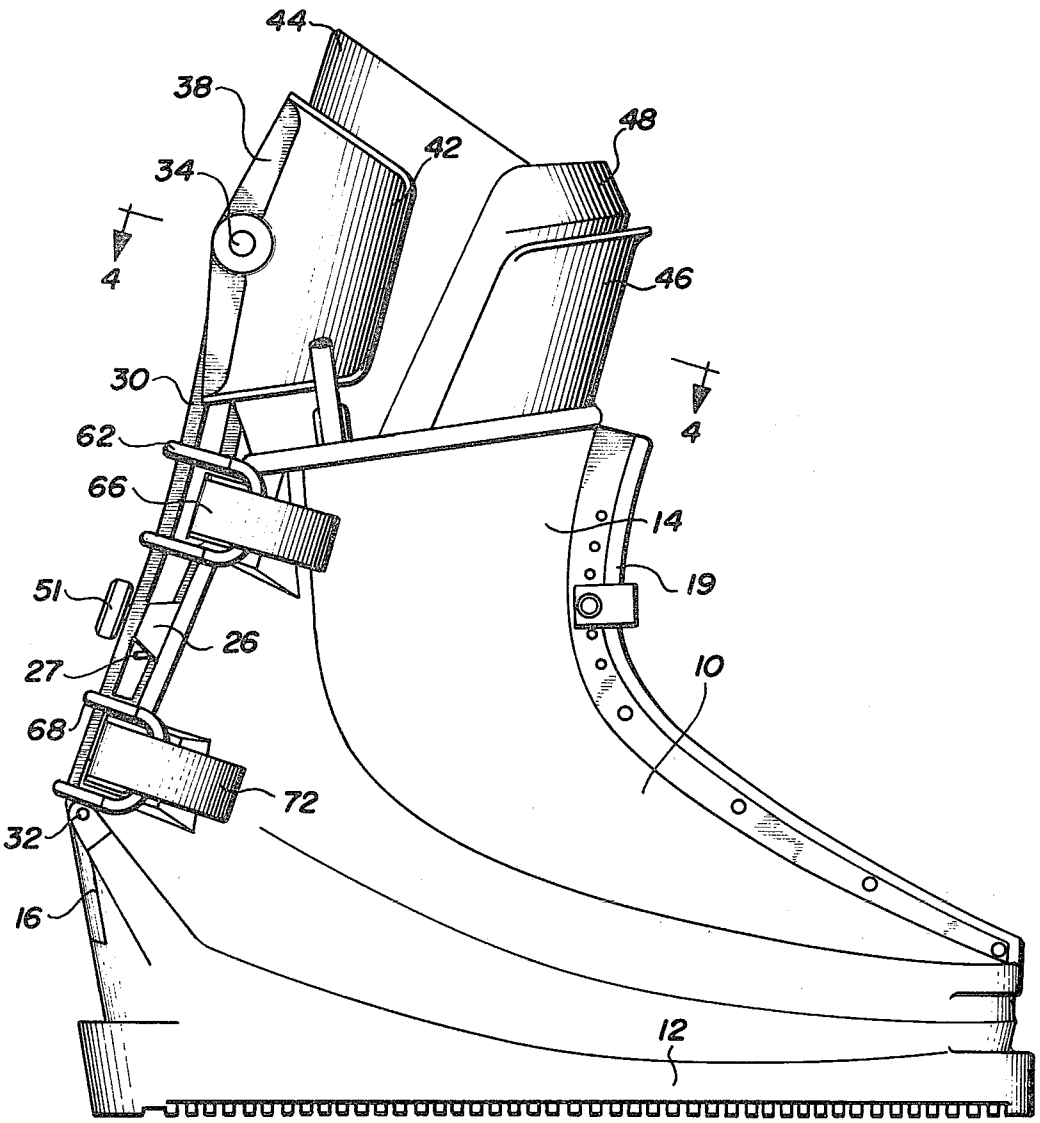
FIG. 1 is a side elevational view of the right side of a right ski boot of the present invention.
Figure 3:
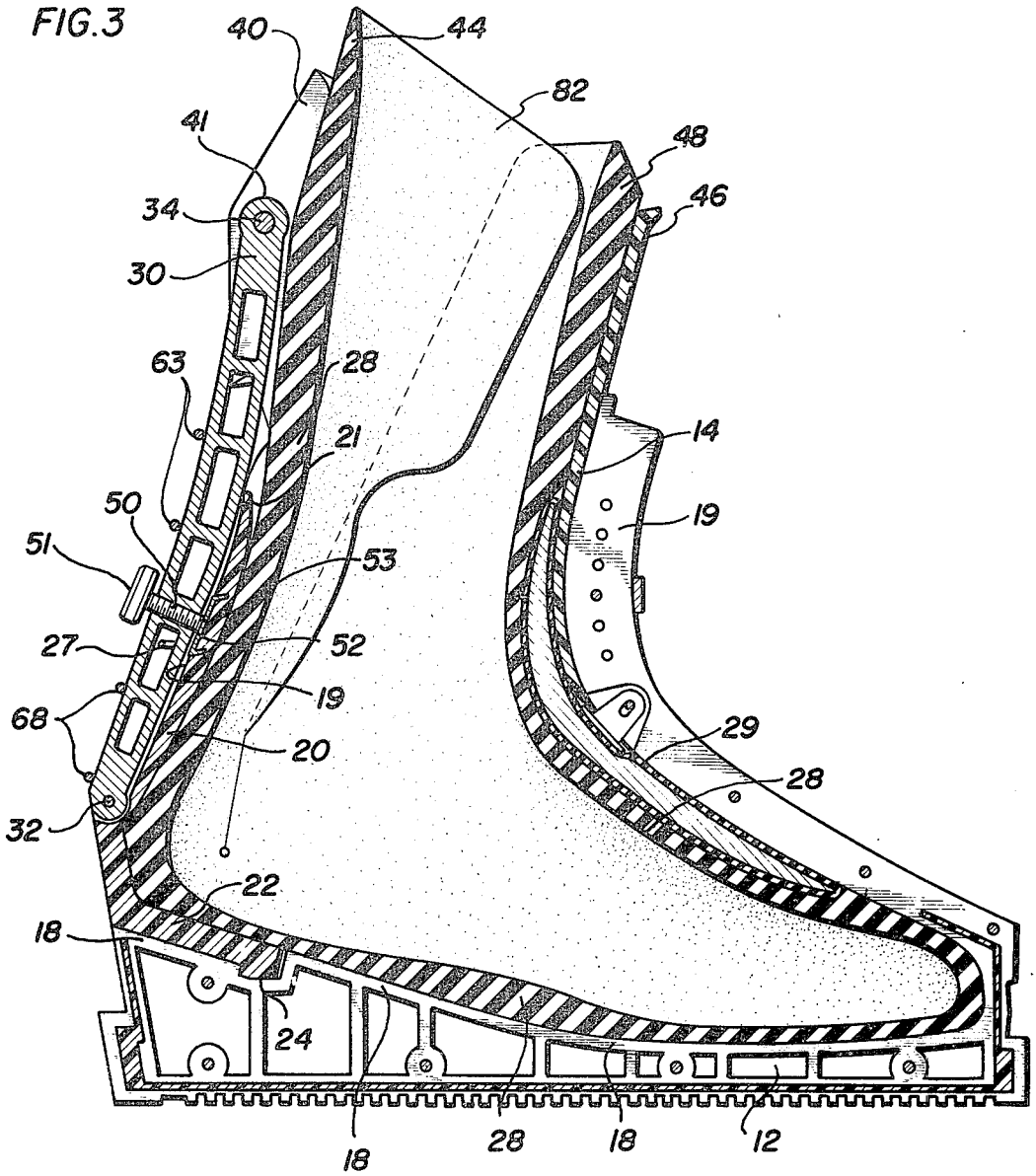
FIG. 3 is a side elevational view, taken in section along line 3—3 of FIG. 2, showing the inside (or left) half of a boot for the right foot.

Referring to the drawings, and more particularly FIGS. 1 and 3, there is shown a ski boot 10 which includes a rigid sole 12 which is adapted to engage ski bindings. Attached to the sole 12 is a vamp 14, into which a liner or padding member 28 is positioned for movement relative to vamp 14. Member 28 is adapted to receive the foot of the skier. The vamp has a rear opening 16, which allows entry of a skier's foot, at least partially, from the rear. Preferably rear opening 16 extends substantially to the floor 18 of the vamp where the foot of the skier normally rests, in juxtaposition with the liner member 28.

As is shown in the drawings, it is preferred that the vamp 14 comprise an adjustable flexible front structure 19, including front member 46, of the type described and claimed in U.S. Pat. No. 3,848,347.

A rear tongue member 20 is pivotally attached to vamp 14, contiguous to the lowermost portion of rear opening 16. In the preferred embodiment, the tongue includes an extension 22, affixed to the lowermost portion of said tongue 20. Preferably, extension 22 is adapted to engage a slot in vamp floor 18. The extension 22 preferably includes a lug 24 which is adapted to engage a corresponding notch in the floor 18 of the vamp, whereby the tongue 20 is pivotally, and removably, locked to the vamp 14. By this arrangement, tongues of various configuration, height and structure may be interchanged, as is described and claimed in U.S. Pat. No. 3,803,730.

Figure 2:
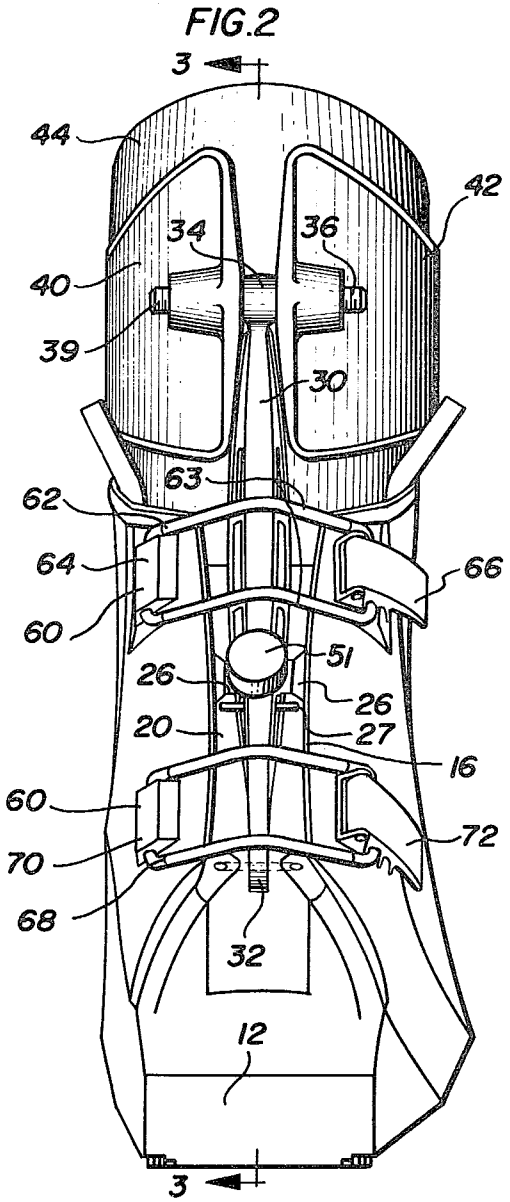
FIG. 2 is a rear elevational view of the ski boot of the present invention.

Beam member 30, which forms an essential element of the present invention, is mounted to the rear of tongue member 20. Beam member 30 which can be made of aluminum or other suitable material is fastened at one of its ends the tongue 20 at pivot 32 by any suitable means. As is shown in FIG. 6, the beam member 30 may be pivoted in a slot 33 about pivot 32', or as is shown in FIG. 3, it may be simply pivoted around pivot 32. As is shown in FIGS. 1 and 2, the beam member is prevented from shifting laterally by beam engaging projections 26, which project from tongue member 20 and which fixedly position beam member 30.

In the preferred embodiment, shown in FIGS. 5, 6, and 7, beam member 30' includes a pair of wing extensions 31, which extend under the rear portions or flaps of the vamp 14. Preferably, the wing extensions 31 are located at about the level of the upper cable clamp 64' and upper buckle closure 66', as is shown in FIG. 5. As can be clearly seen in FIG. 7, the wing extensions 31 extend under the flaps of vamp 14 where they are disposed between the tongue 20 and the rearmost extensions of the vamp 14 on which the upper closure means 62' is mounted. The wing extensions 31 serve to support the closure means and prevent the closure means from being canted inwardly, in which instance the closure means may be forced open. When beam member 30' includes wing projections 31, beam engaging projections 26 may be eliminated, if desired.

Beam member 30, preferably, extends above the uppermost point on vamp 14 although the height of beam member 30 may be either greater or less than the height of the vamp 14. As shown in FIG. 3, beam member 30 extends beyond the end on top of tongue member 20. Tongue member 20 preferably extends in height to a position where it is located, when the boot is closed, approximately midway between cables 63 on buckle closure 60.

At the upper end of beam member 30 there is located upper pivot point 34 through which horizontal screw 36 is positioned to engage cuff assembly 38. Cuff assembly 38 preferably includes an inner cuff 40 and an outer cuff 42. Cuffs 40 and 42 are asymmetric both as to length and thickness in order to control the flexibility thereof and control the support rendered to the rear-side of the wearer's leg. Generally it is contemplated that inner cuff member 40 be longer and less flexible or more rigid, in order to give greater support when the skier edges the inside edge of the ski. The cuff assembly is padded or lined with cuff padding 44 which is part of the unitary liner member 28. If desired, however, a separate padding or liner could be utilized with the cuffs 40, 42. Cuff padding 44 preferably is adapted to overlap and cooperate with the front padding 48 in order to provide padding completely around the wearer's ankle. It is preferred to use a one piece padding assembly 28, as is shown in FIG. 1, in order to permit movement of the padding assembly, with respect to the vamp, and thereby avoid chaffing of the skier's leg as the boot 10 is flexed during skiing.

The use of horizontal screw 36 at the upper end 41 of beam member 30 permits inner and outer cuff members 40 and 42 to be individually and laterally adjusted to accommodate legs of different width. Additionally, adjustable lateral movement of cuff members 40, 42 assists in providing the proper cant of the leg of the ski boot wearer realtive to the ski. Each cuff member can be moved independently of the other by turning the cuff member along threaded screw 36.

The boot of the present invention includes closure means 60. Preferably, the closure means include both an upper and lower closure means. Upper cable 62, which includes cable portions 63, is held by upper clamp 64 and is adapted to engage upper buckle 66. Lower cable 68, held by lower clamp 70, is adapted to engage lower buckle 72.

Because beam member 30 is locked into a substantially fixed relationship with sole 12 when closure means 60 is secured, the location of the cuff assembly pivot point 34 is substantially rigidly fixed with respect to the sole 12 of the boot. Cuff assembly 38 is pivotally affixed to beam member 30 at pivot point 34, whereby cuff members 40, 42 can move relative to beam member 30.

When wing extensions 31 are employed as shown in FIG. 7 and the boot is in the closed position, the extensions 31 extend between rear tongue 20 and the rear portion of the vamp 14 and underlie the closure members, i.e., clamp 64' and buckle 66'. When cable 62' is engaged in buckle 66' and tension is taken on cable 62', the presence of the wing extensions 31 thereunder prevents the rear portions of the vamp 14 from canting or rotating inwardly. Additionally, extensions 31 serve to hold beam member 30 in a fixed position, and preclude the beam from lateral movement in a manner shown in FIGS. 1 and 2.

As can be seen from the drawings, and particularly FIGS. 1 and 3, cables 62 and 68 are drawn across the rear portion of beam member 30 when the boot is in the closed position. When the cables 62 nd 68 are held under tension by buckles 66 and 72, beam member 30 is connected to vamp 14 and is firmly held in position relative to vamp 14 and sole 12. A skier, skiing in boot 10 of the present invention, can exert backward pressure on cuffs 40, 42 of cuff assembly 38, which will pivot about the longitudinal axis of screw 36 without substantial movement of beam member 30 and tongue member 20. The wearer of the ski boot of the present invention is also able to lean in a forward direction because of the adjustable forward flex feature shown in FIG. 1 and described in U.S. Pat. No. 3,848,347.

As will be clear from the drawings, the amount or angle of forward lean of the cuff, with respect to the sole, can be adjusted by tightening or loosening the upper closure means 60 and particularly cable 62, clamp 64 and buckle 66.

In the embodiment shown in FIG. 3, beam member 30 includes a threaded member 50 which bears against pressure plate 52 which is partially embedded or molded in the rear 19 of tongue member 20. Member 50 having knurled knob 51 or other suitable turning means is adapted to be screwed into and out of beam 30, whereby end 53 can bear against plate 52. When screw 50 is turned to cause end 53 to bear on pressure plate 52, tongue member 20 will cause pressure to be increased on the back of liner 28 and the heel and Achilles tendon of the wearer. It is also expected that turning of screw 51 to increase the pressure on plate 52 will cause liner 28 to be moved forward relative to the sole 12 of the boot thereby causing the foot of a skier to be shifted in the boot to increase the pressure on the top of the foot. Thus forward thrust on the rear portion of the liner 28 is expected to provide a snugger, tighter fit for the wearer. Further, threaded member 50 screwed in beam member 30 serves to provide a means for adjustment in fit and flexibility. The adjustment can be readily and conveniently made while skiing without need of removing the boot from the foot of the wearer.

FIG. 6 shows a preferred embodiment of threaded member 50', which includes a flared member 53' which acts as the bearing surface on the inward end of threaded member 50'. In other words, threaded member 50' is inwardly terminated by flared member 53', and member 50' can comprise a conventional flathead, threaded screw which is inserted in beam member 30 from the inward side, and screwed toward the outward side. Preferably, however, a knurled knob 51' is fixed to the outer end of threaded member 50' whereby threaded member 50' can be adjusted inwardly and outwardly. Flared member 53' is adapted to bear against plate 52' which may be embedded in the rear tongue member 20, in the same manner as is shown in FIG. 3.

It is desired, as is shown in FIG. 2, that the beam member 30 be approximately on the center line of the boot. The exact location of the beam laterally is controlled by the placement of the lower pivot point, 32, and the wing extensions 31 or the beam engaging projections 26. The beam engaging projections 26, if used, help prevent any twisting of the beam member. In those cases in which a tongue member 20 is employed, additional beam engaging projections may be used at higher elevations, for example above the center line of the upper cable 62 and clamp 64 assembly.

As is shown in FIGS. 1, 2, and 3, retention cable 27, or a similar device may be used to affix the beam member to the tongue member. The retention cable 27 assures that the beam member 30 will stay within the confines of the beam engaging projections 26 of the tongue. Further, the retention cable 27 assists a skier in opening the boot, since it assures that when the beam member 30 is pulled rearwardly to open the boot, the tongue 20 is simultaneously pulled open.

Figure 4:
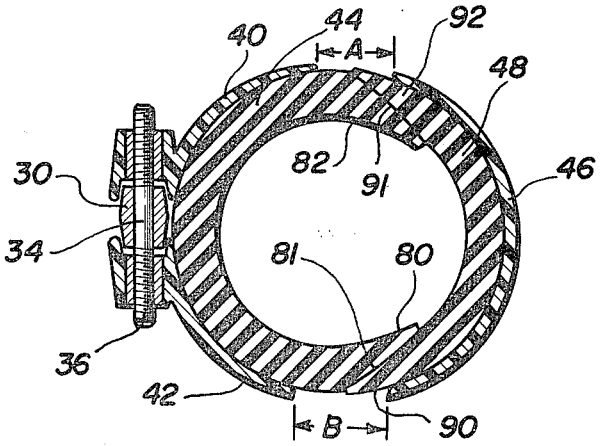
FIG. 4 is a top view of the boot, taken in section along line 4—4 of FIG. 1.

As was mentioned above, it is preferred that the cuff assembly 38 be asymmetric, whereby there is more lateral stability to the inside of the boot than to the outside of the boot. Referring to FIG. 4, it will be noted that the distance A between the edge of cuff 40 and the edge of member 46 is shorter in length than the corresponding distance B between the edge of cuff 42 and the edge of member 46. This arrangement of the cuff assembly serves to provide the skier with more lateral freedom to the outside edge of the boot. Thus it is expected that a skier will be able to flatten his uphill ski, which would be difficult if his leg is too specifically contained. Lateral stability on the inside of the boot will serve to promote ease of edging the inside edge of the ski.

Preferably the ski boot of the present invention employs a one-piece liner 28, which is not glued to vamp 14, cuff assembly 38, rear tongue 20 or member 46. The one-piece liner helps to keep snow out, particularly from a boot structure which has an adjustable forward flexing means, and is shown in the drawings. Further, it has been found that a one-piece liner gives a greater continuity of fit and control over a wide range of sizes. The liner is adapted to move relative to vamp 14. This eliminates a gluing operation which serves not only to reduce the costs of assembly, but it also reduces chaffing of a skier's leg on the liner as the boot is flexed while skiing.

As seen more clearly in FIGS. 3 and 4, liner 28 has portions 80, 82 wrapped within outer portions 90, 92, respectively. This wraparound feature of at least the top portion of the liner assists in keeping snow from entering the liner in the area where the liner extends beyond the top of vamp 14. Wrapping the liner in this manner serves to provide seals at 81, 91 as liner portions 80, 90 and 82, 92 contact each other.

Through the use of the cuff assembly 38, raised above the vamp of the boot, it is possible to use a softer material in the vamp than is used in the cuff assembly. Generally it is preferred to use polycarbonate or some other similar relatively inflexible material to fabricate the cuff members, while the vamp portion of the boot can be made out of softer materials such as flexible polyurethanes. The wing members of the cuff assembly may conveniently be attached to beam member 30 through the use of horizontal screw 36, with screw 36 being fixedly secured to beam member 30 at the centermost portion of any suitable means. Those skilled in the art will recognize that various types of locking means may be used in connection with screw 36, to prevent excessive rotation or flopping of cuff assembly 38 about screw 36.

The use of rigid plastic materials in the cuff assembly permits the construction of cuffs which are thinner and lighter. Since the members can be made from thinner sections, it is expected that a lighter boot can be constructed.

Although the preferred embodiment contemplates mounting the beam member 30 on the tongue member 20, those skilled in the art will recognize that the beam member may also be mounted on the vamp 14 or on the sole 12.

The forms of the invention herein shown and described are to be considered only as illustrative. It will be apparent to those skilled in the art that numerous modifications may be made therein without departure from the spirit of the invention or the scope of the appended claims.

What is claimed is:

1. A ski boot comprising:

a sole having a semi-rigid vamp attached thereto, said vamp having a rear opening;

a rigid beam member, positioned to the rear of said opening, said beam member being connected to said boot and being horizontally pivoted at one of its two ends on a lateral axis contiguous to the lowermost portion of said opening;

closure means adapted to fix said beam member with respect to said semi-rigid vamp; and cuff assembly means pivotally attached to said beam contiguous to the remaining beam end, said cuff means being adapted to support the back and sides of the leg of a person wearing said ski boot.

2. A ski boot as described in claim 1, wherein said cuff means comprise a pair of independently moveable cuff members attached to said beam member.

3. A ski boot as described in claim 2, wherein said moveable cuff members are pivotable about a horizontal axis at the point of attachment to said beam member.

4. A ski boot as described in claim 1, which includes a rear tongue mounted contiguous to the lowermost opening of the vamp, and interior of said beam member.

5. A ski boot as described in claim 4, wherein said beam member comprises a pair of wing extensions disposed between said rear tongue and said vamp.

6. A ski boot as described in claim 4, wherein the lowermost portion of said beam is affixed to said tongue, said tongue being affixed to said boot.

7. A ski boot as described in claim 4, wherein said beam member includes a screw means for adjusting the position of said tongue member relative to said beam.

8. A ski boot as described in claim 7, wherein said tongue member includes a pressure plate adapted to engage the screw member of said beam.

9. A ski boot as described in claim 7, wherein said screw member is inwardly terminated by a flared member.

10. A ski boot as described in claim 1, wherein said beam member exceeds the height of said vamp, when said boot is in the closed position.

11. A rear entry ski boot comprising:

a rigid sole having a semi-rigid vamp attached thereto, said vamp having a rear opening therein extending adjacent to the floor of said vamp;

a liner means disposed with said boot;

a rigid beam member pivotally attached to said boot contiguous to the lowermost portion of said rear opening;

closure means adapted to fix said beam member with respect to said vamp; and cuff means pivotally mounted on the upper portion of said beam member, said cuff means adapted to support the back and side of the leg of the wearer.

12. A rear entry ski boot as described in claim 11, wherein said cuff means comprise a pair of independently moveable members attached to said beam member.

13. A rear entry ski boot as described in claim 12, wherein said moveable cuff members are pivotable about a horizontal axis at the point of attachment to said beam member.

14. A rear entry ski boot as described in claim 11, which includes a rear tongue member mounted contiguous to the lowermost opening of the vamp, and between said liner and said beam member.

15. A ski boot as described in claim 11, wherein said beam member comprises a pair of wing extensions disposed between said rear tongue and said vamp.

16. A ski boot as described in claim 15, wherein said wing members extend beneath said closure means.

17. A rear entry ski boot as described in claim 14, wherein the lowermost portion of said beam member is affixed to said rear tongue.

18. A ski boot as described in claim 14, wherein said beam member includes a screw means for adjusting the position of said tongue member relative to said beam member.

19. A ski boot as described in claim 18, wherein said tongue member includes a pressure plate adapted to engage the screw member of said beam.

20. A ski boot as described in claim 18, wherein said screw member is inwardly terminated by a flared member.

21. A ski boot comprising:

a sole having a semi-rigid vamp attached thereto;

a rigid beam member extending above said vamp and fixed to said vamp;

said beam member being laterally centered and positioned forward of vertical in the direction toward the front of the boot;

cuff means pivotally attached to the uppermost portion of said beam member, said cuff means adapted to support the back and sides of the leg of a person wearing said ski boot; and closure means adapted to position said beam member in a fixed position relative to said vamp.

22. A ski boot as described in claim 21, wherein said beam member comprises wing extensions which extend under said closure means.

* * * * *